US008593353B2

(12) United States Patent
Byun et al.

(10) Patent No.: US 8,593,353 B2
(45) Date of Patent: Nov. 26, 2013

(54) ANTENNA DEVICE FOR A PORTABLE TERMINAL

(75) Inventors: Joon-Ho Byun, Suwon-si (KR); Soon-Ho Hwang, Seoul (KR); Mun-Il Kim, Seoul (KR); Do-Won Kim, Seoul (KR); Hyun-Seok Park, Seoul (KR)

(73) Assignees: Samsung Electronics Co., Ltd. (KR); Korea University Industrial & Academic Collaboration Foundation (KR)

( * ) Notice: Subject to any disclaimer, the term of this patent is extended or adjusted under 35 U.S.C. 154(b) by 368 days.

(21) Appl. No.: 12/999,802

(22) PCT Filed: Jun. 12, 2009

(86) PCT No.: PCT/KR2009/003171

§ 371 (c)(1),
(2), (4) Date: May 20, 2011

(87) PCT Pub. No.: WO2009/154376

PCT Pub. Date: Dec. 23, 2009

(65) Prior Publication Data

US 2011/0210897 A1 Sep. 1, 2011

(30) Foreign Application Priority Data

Jun. 19, 2008 (KR) ..... 10-2008-0057814

(51) Int. Cl.
*H01Q 1/24* (2006.01)

(52) U.S. Cl.
USPC ..... 343/702; 343/700 MS; 343/749

(58) Field of Classification Search
USPC ..... 343/700 MS, 702, 749, 829, 846
See application file for complete search history.

(56) References Cited

U.S. PATENT DOCUMENTS

| | | | | |
|---|---|---|---|---|
| 5,483,249 | A * | 1/1996 | Kennedy | 343/846 |
| 6,819,287 | B2 * | 11/2004 | Sullivan et al. | 343/700 MS |
| 6,842,149 | B2 * | 1/2005 | Taubman | 343/702 |
| 7,760,146 | B2 * | 7/2010 | Ollikainen | 343/702 |
| 7,990,320 | B2 * | 8/2011 | Pros et al. | 343/700 MS |
| 8,339,321 | B2 * | 12/2012 | Nagano et al. | 343/702 |
| 2005/0237251 | A1 | 10/2005 | Boyle et al. | |
| 2005/0270240 | A1 | 12/2005 | Qi et al. | |
| 2006/0055606 | A1 | 3/2006 | Boyle | |

FOREIGN PATENT DOCUMENTS

| | | |
|---|---|---|
| KR | 1020040108759 | 12/2004 |
| KR | 1020050007557 | 1/2005 |
| KR | 1020070001175 | 1/2007 |
| KR | 1020070098020 | 10/2007 |

OTHER PUBLICATIONS

PCT/ISA/237 Written Opinion issued on PCT/KR2009/003171 (10 pp.).

* cited by examiner

*Primary Examiner* — Tho G Phan
(74) *Attorney, Agent, or Firm* — The Farrell Law Firm, P.C.

(57) ABSTRACT

An antenna device for a portable terminal includes: a ground pattern provided on one surface of a circuit board; a first antenna pattern configured to resonate at a first frequency band and provided on an opposite surface of the circuit board; and a second antenna pattern configured to resonate at a second frequency band different from the first frequency band and arranged along a periphery of the ground pattern. The second antenna pattern is a zeroth order mode resonator including a plurality of capacitors and a plurality of inductors. The antenna device easily secures the operation characteristics of different operation frequency bands and contributes to miniaturization of the portable terminal. Thus, a user can conveniently carry and use the portable terminal.

12 Claims, 7 Drawing Sheets

ANTENNA DEVICE FOR A PORTABLE TERMINAL

PRIORITY

This application claims priority under 35 U.S.C. §119(a) of a Korean Patent Application filed in the Korean Intellectual Property Office on Jun. 19, 2008, assigned Ser. No. 10-2008-0057814, and to PCT/KR2009/003171 filed Jun. 12, 2009, the disclosure of each of which is hereby incorporated by reference.

TECHNICAL FIELD

The present invention relates to a portable terminal, and more particularly to an antenna device that allows a user to use various mobile communication services provided at different frequency bands through a single portable terminal.

BACKGROUND ART

In general, an antenna device for a portable terminal refers to a device that allows a user to use mobile communication services through a portable terminal by performing wireless communications with a mobile communication base station.

Mobile communication services provided through a portable terminal at the initial stage were, for example, voice communications and transmission of short messages which were commercialized by simple communications through which data of low capacity were transmitted and received at a low speed. However, in recent years, various types of services such as transmission of videos, real-time searches through the internet, digital multimedia broadcasting (hereinafter, referred to as 'DMB') are being provided, so it is required to transmit and receive data of high capacity at a high speed. Thus, in an antenna device for a portable terminal, it is required not only to optimally utilize a bandwidth defined at its operation frequency but also to simultaneously receive various services provided at different frequency bands if necessary. For example, in order to use a mobile communication service and a DMB service through a single portable terminal, it is necessary for the portable terminal to simultaneously receive services provided at different frequency bands.

Due to many efforts for improving the performances of antenna devices according to changes in the mobile communication service environment, there have been many difficulties in realizing antenna devices capable of simultaneously receiving mobile communication services provided at different frequency bands while it becomes possible to transmit data of high capacity through which videos can be watched and an internet service can be used in real time at a high speed.

That is, when an antenna device is manufactured by combining antenna elements operated at different frequency bands, the operation characteristics of the antenna elements are unavoidably distorted due to the interferences between the antenna elements. Thus, there have been many trials and errors in optimizing an antenna device of dual bands.

Moreover, an antenna device has an electrical length which is a half or a quarter of an operation frequency wavelength, whereas since a mobile communication service is provided at a relatively high frequency band (for example, 900 MHz, 1.8 GHz, and 2.1 GHz), the antenna device can be easily miniaturized and can thus be mounted to the interior of a terminal. However, it is unavoidable to increase the electrical length or volume of an antenna device in order to use a service, such as a ground-wave DMB, which is provided at a low frequency band (for example, 200 MHz). Thus, when an antenna device for using a service of low frequency band is embedded in a terminal, the size of the terminal becomes larger and it becomes inconvenient to carry the terminal.

Due to the above problems, while some portable terminals are miniaturized, detachable antenna modules for using ground-wave DMB services are provided in the portable terminals separately. However, in this case, it is inconvenient to carry a detachable antenna module and it is also bothersome for a user to couple an antenna module in order to watch a DMB service.

DISCLOSURE

Technical Problem

Therefore, the present invention has been made in view of the above-mentioned problems, and the present invention provides an antenna device for a portable terminal that secures stable operation characteristics at different frequency bands while forming a single module in shape.

The present invention also provides an antenna device that contributes to miniaturization of a terminal while being stably operated at different frequency bands.

The present invention further provides an antenna device that allows a user to carry and use a portable terminal conveniently as well as to use services provided at different frequency bands through the portable terminal.

Technical Solution

In accordance with an aspect of the present invention, there is provided an antenna device for a portable terminal including: a ground pattern provided on one surface of a circuit board; a first antenna pattern configured to resonate at a first frequency band and provided on an opposite surface of the circuit board; and a second antenna pattern configured to resonate at a second frequency band different from the first frequency band and arranged along a periphery of the ground pattern, wherein the second antenna pattern is a zeroth order mode resonator including a plurality of capacitors and a plurality of inductors.

The first antenna pattern may be one of a loop-shaped pattern, an inverted L-shaped pattern, an inverted F-shaped pattern, or an meander line pattern.

At least one portion of the second antenna pattern may face a portion of the first antenna pattern with the circuit board being interposed therebetween such that power is fed to the second antenna pattern by electric field coupling.

The first frequency band may be a mobile communication frequency band of one of 900 MHz, 1.8 GHz, and 2.1 GHz and the second frequency band is a ground-wave DMB frequency band of 200 MHz.

The second antenna pattern may further include radiation patterns, and the plurality of capacitors may be connected in series via the radiation patterns and the plurality of inductors may be connected in parallel via the radiation patterns and the ground pattern.

A resonance frequency at the second frequency band may be set by a capacitance of the capacitor and an inductance of the inductor, or by adjusting a length of each radiation pattern.

A radiation characteristic of the second antenna pattern may be adjusted by adjusting an interval between the radiation pattern and the ground pattern.

Advantageous Effects

According to the present invention, since an antenna device includes first and second antenna patterns and the second antenna pattern is formed of a zeroth mode resonator, the second antenna pattern is easily operated as an antenna for a low frequency band (for example, a ground-wave DMB service band of 200 MHz). Since the resonance frequency of the zeroth mode resonator can be adjusted by adjusting capacitance components (capacitances) and inductance components (inductances) irrespective of the physical size thereof, an antenna device capable of operating at a low frequency band can be easily formed.

Accordingly, the present invention provides a small-sized antenna device that can be easily embedded in a portable terminal while operating at different frequency bands. A portable terminal can be miniaturized by embedding the antenna device in the portable terminal such that a user can conveniently carry and use the portable terminal.

Moreover, since the second antenna pattern is installed in an open-end line feeding manner and is formed of a zeroth mode resonator, interference between the first and second antenna patterns can be minimized, making it easy to optimize the operation characteristics of the first and second antenna patterns.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, exemplary embodiments of the present invention will be described with reference to the accompanying drawings. In the following description of the present invention, a detailed description of known functions and configurations incorporated herein will be omitted when it may make the subject matter of the present invention rather unclear.

It is noted that while expressions such as 'relatively high' and 'relatively low' are used in the following description of the present invention, they are used to compare the operation characteristics of a first antenna pattern and a second antenna pattern that will be described hereinbelow.

Figure 1:
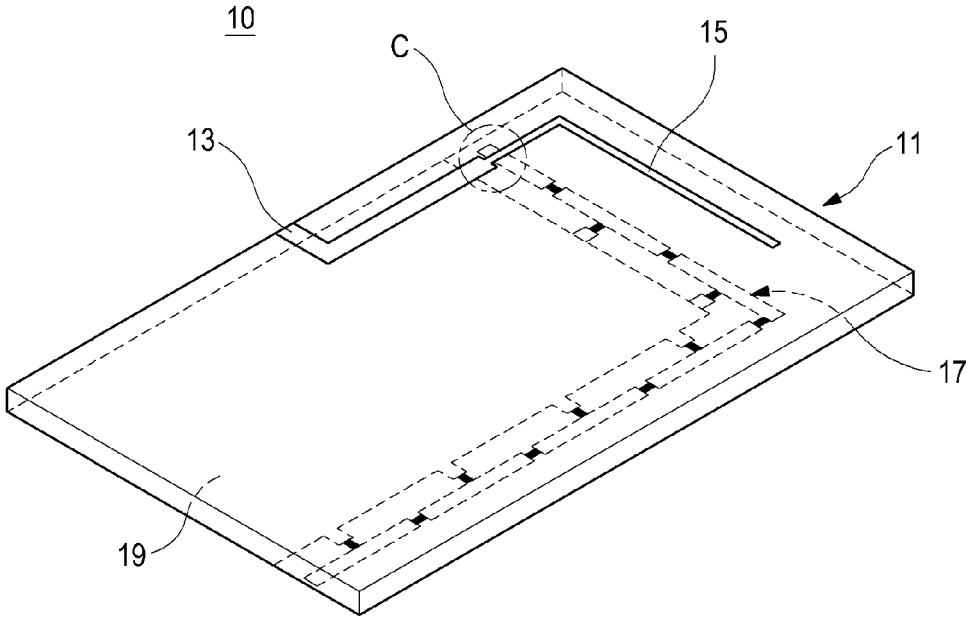
FIG. 1 is a perspective view schematically illustrating an antenna device for a portable terminal according to an embodiment of the present invention.

FIG. 1 is a perspective view illustrating an antenna device 10 for a portable terminal according to an embodiment of the present invention. As illustrated in FIG. 1, the antenna device 10 includes a ground pattern 19 provided on one surface of a circuit board 11, and a second pattern 17 formed along a periphery of the ground pattern 19. Further, a first antenna pattern 15 is provided on an opposite surface of the circuit board 11.

The first antenna pattern 15 is a printed circuit pattern provided on the opposite surface of the circuit board 11, and one end thereof is connected to a power feeding terminal provided on the opposite surface of the circuit board 11 such that power is fed to the first antenna pattern 15. The first antenna pattern 15 may be one of a loop-shaped pattern, an inverted L-shaped pattern, an inverted F-shaped pattern, and a meanderline pattern and resonates at a first frequency band.

Here, the first frequency band may be a relatively high frequency band, such as 900 MHz, 1.8 GHz, and 2.1 GHz, which is used to provide a commercialized mobile communication service. The length of first antenna pattern 15 which is one of a loop-shaped pattern, an inverted L-shaped pattern, an inverted F-shaped pattern, and a meanderline pattern is a half or a quarter of its resonance frequency wavelength. Then, since the first antenna pattern 15 is operated at a relatively high frequency band, its electrical length may be small enough for the first antenna pattern 15 to be mounted to the portable terminal. In fact, many currently commercialized terminals provide mobile communication services using such built-in antennas.

Figure 2:
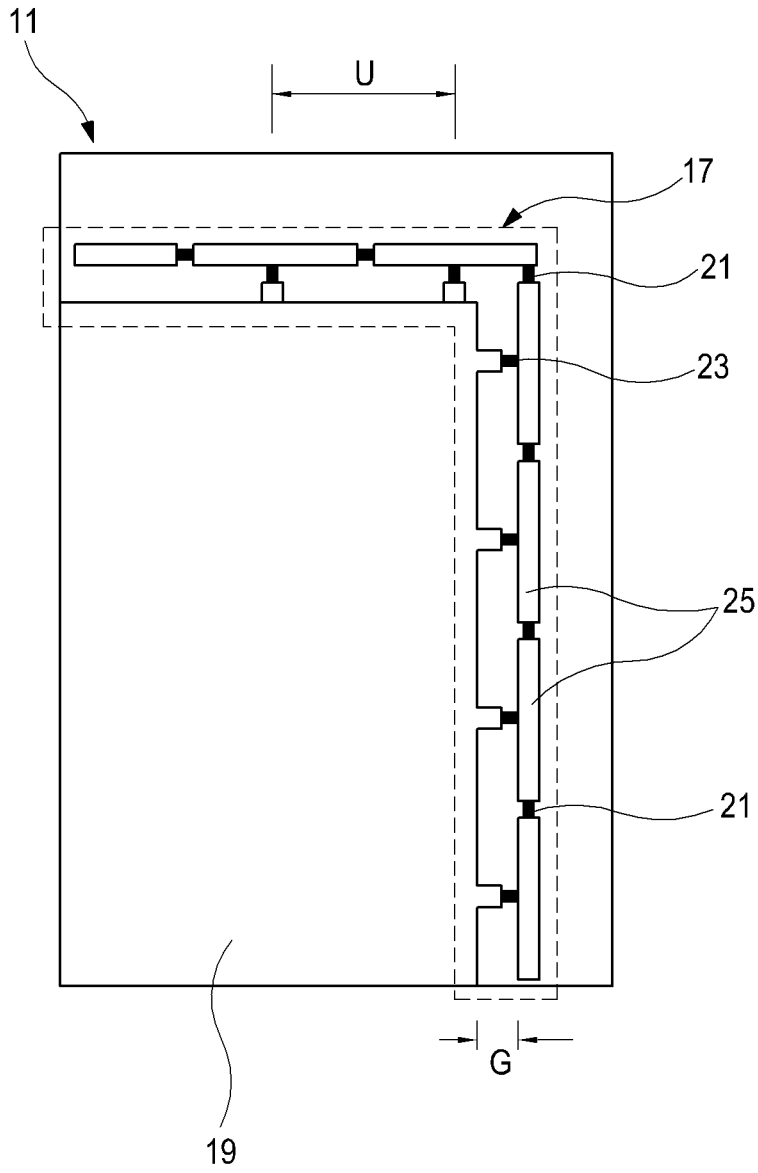
FIG. 2 is a top view illustrating a second antenna pattern of the antenna device of FIG. 1.

Referring further to FIG. 2, the second antenna pattern 17 is formed along a periphery of the ground pattern 19 and includes capacitors 21, inductors 23, and radiation patterns (generally called as 'unit-cells') 25. The capacitors 21 are connected in series via the radiation patterns 25 and the inductors 23 are connected in parallel via the radiation patterns 25 and the ground pattern 19 to form a zeroth order mode resonator having a metamaterial structure. That is, the second antenna pattern 17 is a zeroth order mode resonator. The second antenna pattern 17 resonates at a second frequency band different from the first frequency band, and preferably resonates at a frequency band (for example, 200 MHz where a ground-wave DMB service is provided) lower than the first frequency band.

The zeroth mode resonator has a phase constant of zero at its resonance frequency and the resonance frequency of the zeroth mode resonator is set by its capacitance and inductance irrespective of its overall size or by adjusting the size of a unit call, i.e. the length U of the radiation pattern 25. The radiation characteristics of a resonance frequency may be adjusted by adjusting a gap G between the ground pattern 19 and the radiation pattern 25 in the second antenna pattern 17.

Meanwhile, the second antenna pattern 17 does not directly contact with the first antenna pattern 15 or the power supplying terminal 13, but power is fed to the second antenna pattern 17 by electric field coupling. That is, at least one portion of the second antenna pattern 17 faces the first antenna pattern 15 with the circuit board 11 being interposed therebetween to form an electric field coupling region C, whereby power is supplied to the second antenna pattern 17.

As a result, the second antenna pattern 17 is installed in an open-end line feeding manner and functions as a zeroth mode resonator of a metamaterial structure to minimize interference between the first and second antenna patterns 15 and 17. Accordingly, even when the first and second antenna patterns 15 and 17 are installed on opposite surfaces of the circuit board 11, the first and second antenna patterns 15 and 17 can maintain their own radiation characteristics.

Figure 3:
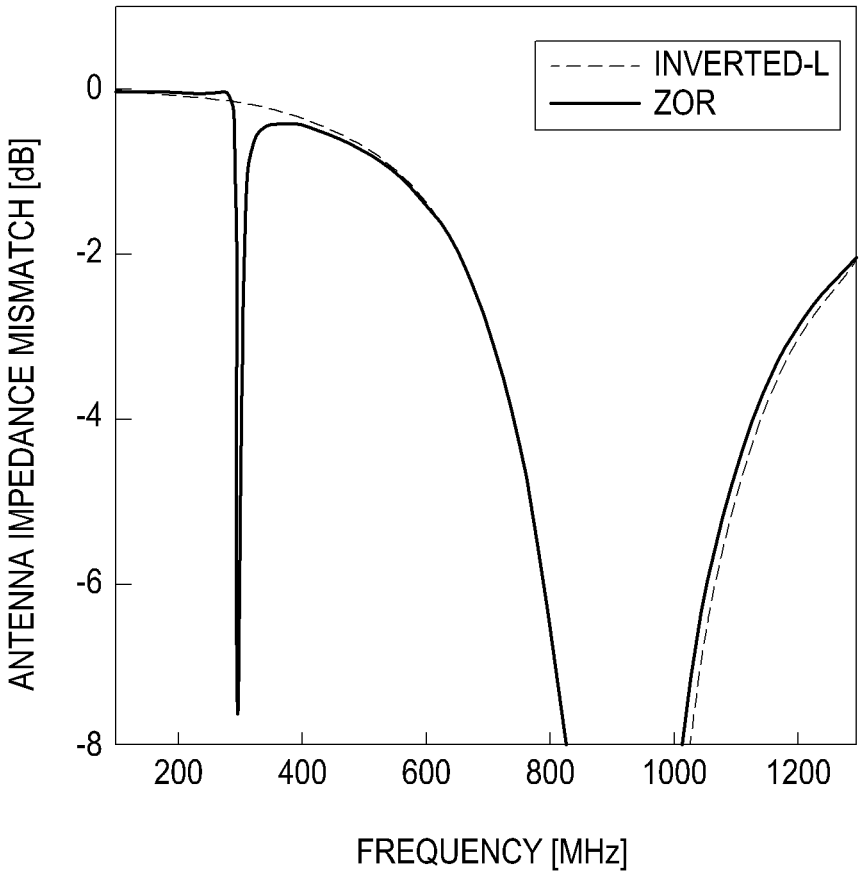
FIG. 3 is a graph illustrating the operation characteristics of the antenna device of FIG. 1.

The characteristics of the antenna device 10 according to the present invention will be described with reference to FIG. 3 hereinbelow. FIG. 3 is a graph for comparing an impedance characteristic (indicated by 'Inverted-L') of an antenna device where a radiation pattern the same as the first antenna pattern 15 is formed using an inverted L-shaped pattern and an impedance characteristic (indicated by 'ZOR') of the antenna device 10 according to the present invention where the first antenna pattern 15 and the second antenna pattern 17 are formed on opposite surfaces of the circuit board 11. It is apparent that while the graph of FIG. 3 represents impedance mismatches of an antenna device at frequencies, signals may be transmitted and received appropriately at a frequency band where an impedance mismatch value is low.

It can be seen from the graph of FIG. 3 indicated by 'Inverted-L' that, in an antenna device where only a radiation pattern is the same as the first antenna pattern 15, an impedance mismatch value is below −8 dB at a frequency range of approximately 800 MHz to 1000 MHz and is above −8 dB at the remaining frequency ranges. It can be also seen that, in the antenna device, signals can be transmitted and received appropriately at a frequency range of approximately 800 to 1000 MHz, and in more detail, at a frequency range of around 900 MHz.

It can be also seen from the graph of FIG. 3 indicated by 'ZOR' that the antenna device 10 where the second antenna pattern 17 is formed in the circuit board 11 having the first antenna pattern 15 according to the embodiment of the present invention can obtain an additional resonance frequency at a frequency band of approximately 300 MHz.

Then, when the graph indicated by 'Inverted-L' and the graph indicated by 'ZOR' are compared, it can be seen that the impedance characteristics of the two different antenna devices are almost the same at the entire frequency bands and an additional resonance frequency (approximately 300 MHz) is generated at the graph indicated by 'ZOR'. That is, even if the second antenna pattern 17 is formed on the circuit board 11 having a mobile communication antenna, i.e. the first antenna pattern 15, an additional resonance frequency can be obtained while the natural operation characteristic of the first antenna pattern 15 is being maintained.

Meanwhile, it has been already described that a resonance frequency can be adjusted by adjusting the electrical length of the first antenna pattern 15. The first antenna pattern 15 is operated at a higher frequency band as its electrical length becomes shorter, and is operated at a lower frequency band as its electrical length becomes longer. However, since the present invention is adapted to provide an antenna device that contributes to miniaturization of a portable terminal, it is preferable that the electrical length of the first antenna pattern 15 is short, and the first antenna pattern 15 may be modified to an antenna pattern that can be operated at frequency bands of 1.8 GHz and 2.1 GHz.

The resonance frequency obtained by the second antenna pattern 17 can be adjusted to a desired frequency band by adjusting the size of a unit cell (i.e. the length of the radiation pattern), one or more capacitances of the capacitors 21, and one or more inductances of the inductors 23. Thus, a resonance frequency can be obtained at the second frequency band lower than the first frequency band using the second antenna pattern 17. Then, since the overall size of the second antenna pattern is irrelevant to a resonance frequency that can be obtained at the second frequency band, the size of the antenna device 10 can be maintained the same as in the case where only the first antenna pattern 15 is formed.

Figure 4:
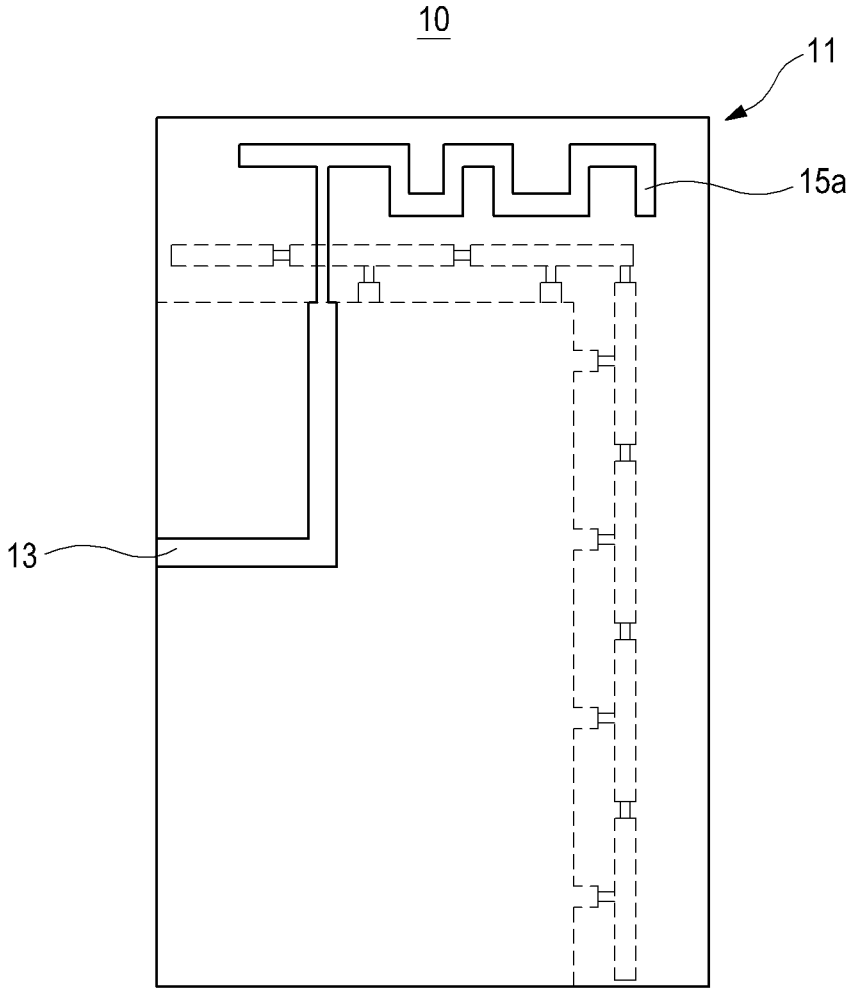
FIGS. 4 and 5 are top views illustrating modifications of a first antenna pattern of the antenna device of FIG. 1.
Figure 5:
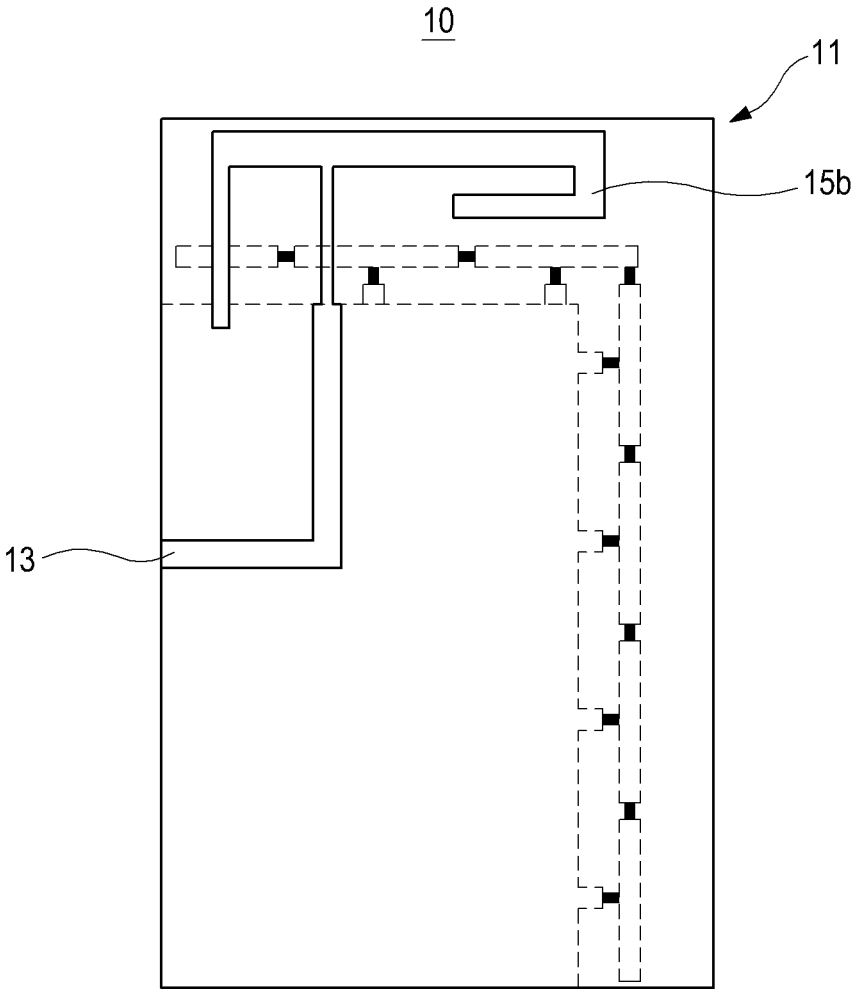

FIGS. 4 to 7 illustrate modifications of the first and second antenna patterns 15 and 17. Referring to FIGS. 4 and 5, the first antenna pattern may be modified to a meander line pattern 15*a* or a pattern 15*b* similar to an alphabet letter 'T'. They may be set appropriately according to an operation frequency band required in an actual product and may also be a loop-shaped pattern and an inverted F-shaped pattern as described above.

Figure 6:
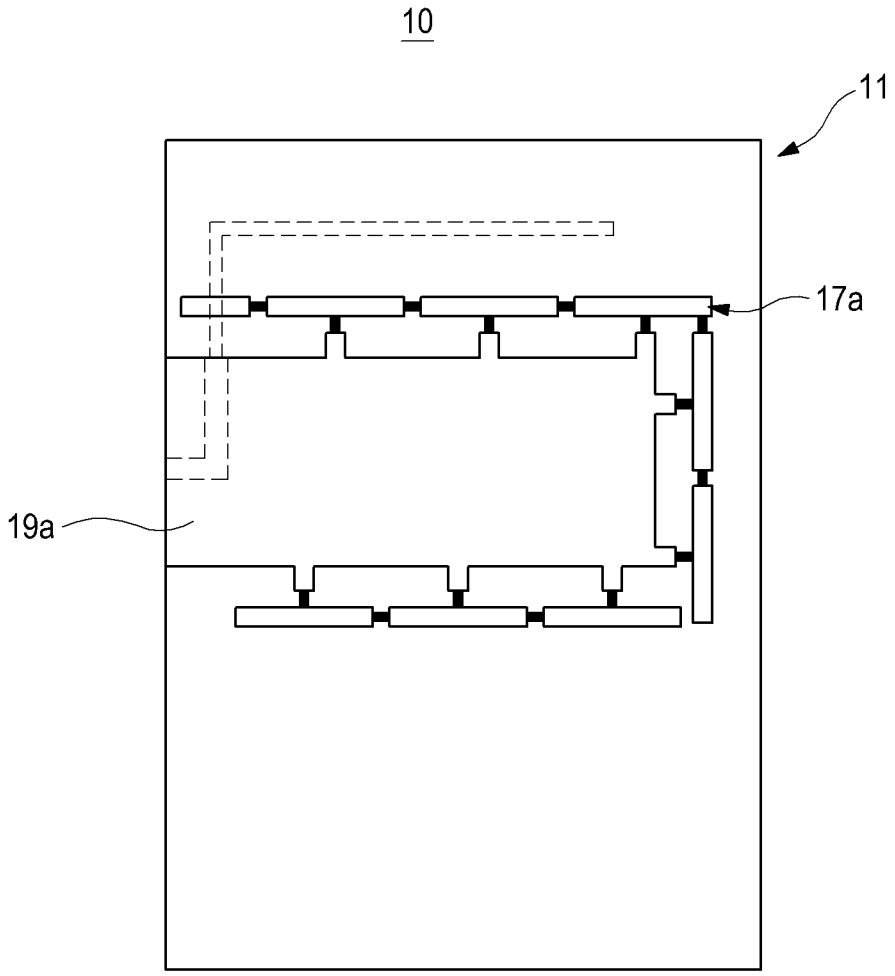
FIGS. 6 and 7 are top views illustrating modifications of the second antenna pattern of the antenna device of FIG. 1.
Figure 7:
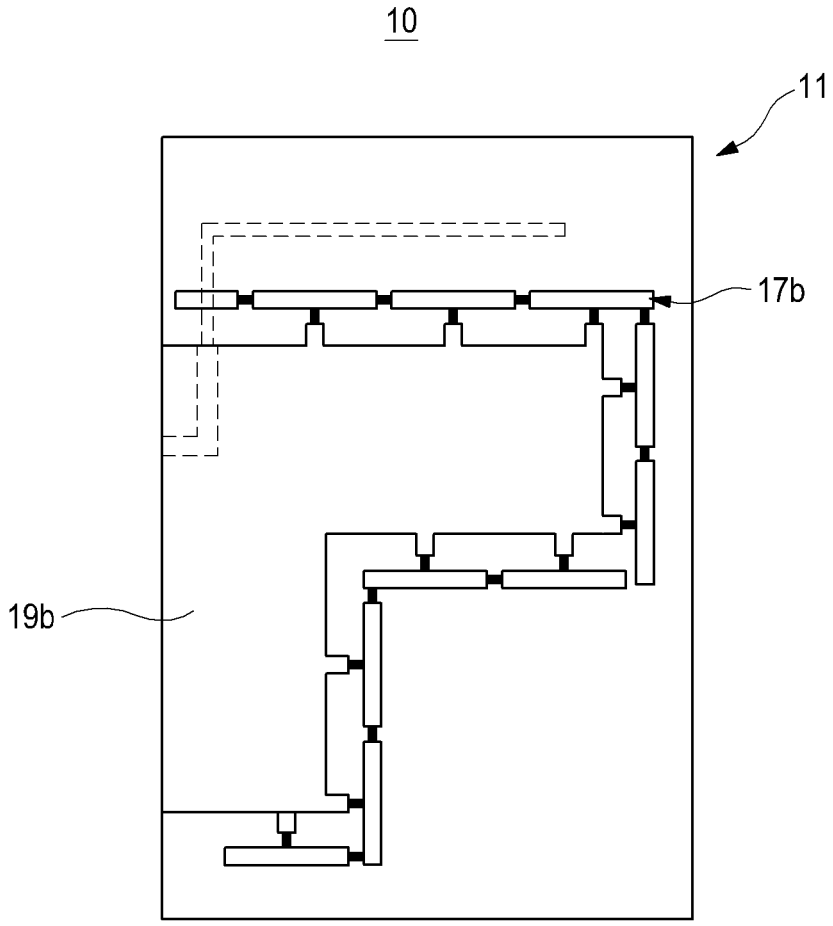

Referring to FIG. 6, the ground pattern 19*a* may be formed to have a rectangular shape which shares one edge of the circuit board 11, and the second antenna pattern 17*a* is formed along a periphery of the ground pattern 19*a*. It can be seen from FIG. 7 that the ground pattern 19*b* is formed to have a shape similar to an alphabet letter 'L' and the second antenna pattern 17*b* is formed along its periphery.

In this way, the ground pattern and the first and second antenna patterns may be modified in a variety of ways, and the ground pattern may share at least one edge of the circuit board.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. An antenna device for a portable terminal comprising:

a ground pattern provided on one surface of a circuit board;

a first antenna pattern configured to resonate at a first frequency band and provided on an opposite surface of the circuit board; and a second antenna pattern configured to resonate at a second frequency band different from the first frequency band and arranged along a periphery of the ground pattern, wherein the second antenna pattern is a zeroth order mode resonator including a plurality of capacitors and a plurality of inductors.

2. The antenna device as claimed in claim 1, wherein the first antenna pattern is one of a loop-shaped pattern, an inverted L-shaped pattern, an inverted F-shaped pattern, or an meander line pattern.

3. The antenna device as claimed in claim 1, wherein power is fed to the first antenna pattern through a power feeding terminal provided at one end of the first antenna pattern.

4. The antenna device as claimed in claim 3, wherein at least one portion of the second antenna pattern faces a portion of the first antenna pattern with the circuit board being interposed therebetween such that power is fed to the second antenna pattern by electric field coupling.

5. The antenna device as claimed in claim 1, wherein the first frequency band is a mobile communication frequency band of one of 900 MHz, 1.8 GHz, and 2.1 GHz and the second frequency band is a ground-wave DMB frequency band of 200 MHz.

6. The antenna device as claimed in claim 1, wherein a resonance frequency at the first frequency band is set by adjusting an electrical length of the first antenna pattern.

7. The antenna device as claimed in claim 1, wherein the ground pattern shares at least one edge of the circuit board.

8. The antenna device as claimed in claim 1, wherein the second antenna pattern further includes radiation patterns, and wherein the plurality of capacitors are connected in series via the radiation patterns and the plurality of inductors are connected in parallel via the radiation patterns and the ground pattern.

9. The antenna device as claimed in claim 8, wherein a resonance frequency at the second frequency band is set by adjusting a length of each radiation pattern.

10. The antenna device as claimed in claim 8, wherein a radiation characteristic of the second antenna pattern is adjusted by adjusting an interval between the radiation pattern and the ground pattern.

11. The antenna device as claimed in claim 8, wherein a resonance frequency at the second frequency band is set by a capacitance of a capacitor and an inductance of an inductor.

12. The antenna device as claimed in claim 1, wherein a resonance frequency at the second frequency band is set by a capacitance of the capacitor and an inductor.

* * * * *